US006335138B1

(12) United States Patent
Kurose et al.

(10) Patent No.: US 6,335,138 B1
(45) Date of Patent: Jan. 1, 2002

(54) PRODUCTION METHOD OF TONER

(75) Inventors: Katsunori Kurose, Amagasaki; Masahiro Anno, Sakai; Chikara Tsutsui, Nishinomiya; Minoru Nakamura, Takarazuka; Hiroyuki Fukuda, Sanda, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/478,987

(22) Filed: Jan. 7, 2000

Related U.S. Application Data

(62) Division of application No. 09/289,947, filed on Apr. 13, 1999, now Pat. No. 6,022,661.

(30) Foreign Application Priority Data

Apr. 14, 1998 (JP) ..... 10-103022
Mar. 11, 1999 (JP) ..... 11-064575

(51) Int. Cl.[7] ..... G03G 9/093
(52) U.S. Cl. ..... 430/110.2; 430/137.11
(58) Field of Search ..... 430/109.1, 110.2, 430/111.1, 137.1, 138, 137.11

(56) References Cited

U.S. PATENT DOCUMENTS 4,996,126 A 2/1991 Anno et al.
5,066,558 A 11/1991 Hikake et al.
5,206,109 A 4/1993 Anno
5,232,806 A 8/1993 Yamada et al.
5,350,657 A 9/1994 Anno et al.
5,456,990 A 10/1995 Takagi et al.
5,659,857 A 8/1997 Tamazaki et al.
5,698,354 A 12/1997 Ugai et al.
5,747,209 A 5/1998 Takiguchi et al.
5,753,399 A 5/1998 Hayase et al.
5,774,771 A 6/1998 Kukimoto et al.
5,827,632 A 10/1998 Inaba et al.
5,885,743 A 3/1999 Takayanagi et al.
5,981,129 A * 11/1999 Akazawa et al. ..... 430/137 X
6,132,919 A * 10/2000 Ogawa et al. ..... 430/110
6,207,339 B1 * 3/2001 Kato et al. ..... 430/137

FOREIGN PATENT DOCUMENTS

JP 61-273557 12/1986
JP 63-319037 12/1988
JP 1-257857 10/1989
JP 4-226476 8/1992
JP 5-173360 7/1993
JP 6-317928 11/1994
JP 6-317933 11/1994
JP 9-258474 3/1997

* cited by examiner

*Primary Examiner*—Tuan N. Nguyen
(74) *Attorney, Agent, or Firm*—McDermott, Will & Emery

(57) ABSTRACT

A production method of toner particles has steps of mixing a binder resin and a colorant, melting and kneading the mixture, pulverizing the kneaded material, and classifying the pulverized materials to give a colored resin particles. Then the colored resin particles are mixed with silica particles having an average primary particle size of 16 to 28 nm with the number of particles (A) that are less than 15 nm in particle size, the number of particles (B) that are between 15 and 30 nm in particle size and the number of particles (C) that are larger than 30 nm in particle size having the relation of (B)/(A)>4 and (B)/(C)>4. To obtain toner particles, the resultant mixture is heat-treated to make the colored resin particles spherical and to make the silica particles fixed on the surface of the colored resin particles.

16 Claims, 2 Drawing Sheets

PRODUCTION METHOD OF TONER

This application is a Divisional of application Ser. No. 09/289,947 filed Apr. 13, 1999 now U.S. Pat. No. 6,022,661.

This application is based on applications No. Hei 10-103022 and Hei 11-064575 filed in Japan, the contents of which are hereby incorporated by reference.

BACKGROUND OF THE INVENTION

1. Field of the Invention

The present invention relates to a toner used for developing electrostatic latent images in electrophotography, electrostatic printing, etc.

2. Description of the Related Art

Recently, in response to demands from offices and common users, downsizing, high speeds, low prices and low energy consumption have been aimed in apparatuses such as copying machines and printers. In particular, while high-quality images have been achieved in ink-jet printers, there are increasing demands for high-quality images also in electrophotographic processes.

With respect to developers used for developing electrostatic latent images in systems, such as electrophotography systems and electrostatic printing systems, some of them are conventionally produced by a kneading-pulverization method and a wet method that is typically exemplified by a suspension polymerization method. Moreover, in order to improve characteristics of particles obtained by these methods, after the particles (developer particles) have been prepared, they are subjected to surface-modifying treatments by various methods (mechanical impact force, heat, etc.).

Taking the surface-improvements into consideration, the inventors, etc. have attempted to improve the toner-quality and performance by controlling the toner shape, and reached the following findings:

For example, by making the toner shape as spherical as possible, the following effects may be achieved:

Since the aggregation between toner particles becomes smaller, good quality free from image losses is obtained;

Good transferring efficiency is obtained because of a high moving properties;

Since external stress is applied uniformly, it is possible to avoid local deformation and degradation (uniformity in quality) in toner;

It is possible to reduce undesired phenomenon, such as aggregation, excessive charging and selective developing (a phenomenon in which toner having a specific particle size or a quantity of charge is first consumed selectively), which are inherent disadvantages of a small-particle toner ingredient;

Since the surface shape becomes more uniform as compared with irregular shaped toner, the distribution of charge density on the toner surface becomes more uniform, thereby providing a sharp distribution in the quantity,of charge;

However, although the above-mentioned effects may be obtained, small aggregating properties and high moving properties (in addition to high fluidity) causes scattering upon transferring process and degradation in the cleaning properties.

Scattering is a serious problem which causes degradation in image quality not only in monochrome images but also in color images, and in particular, gives adverse effects on full color processes in which colors are superimposed. With respect to the cleaning properties, defective cleaning-properties such as passing-through phenomenon of toner particles and unswept toner particles may easily occur, in particular when a cleaning blade is used. When these phenomena occur, it becomes difficult to apply an appropriate potential to the photosensitive member, resulting in a drastic change in the developing characteristics. Serious defects in images, such as white spots, fogs, unevenness and memory (a phenomenon in which the previous image pattern appears in the same period) cause conspicuous degradation in the image quality. These disadvantages appear not only in commonly-used photosensitive members, but also in belt-type photosensitive members and intermediate transferring members.

Moreover, the spherical toner, when used together with even a small amount of a commonly-used fluidizing agent, exhibits a very high fluidizing properties, and tends to cause a problem about packing and sealing (toner leakage) inside the machine.

Together with securing downsizing, high speeds and low-temperature fixing performance of the machine, it becomes necessary to ensure the maintenance for heat resistance and the thermal stability (amount of heat resulting from frictional heat from the regulating section and the machine temperature (temperature rise) due to high ambient temperature and heat generated from the fixing device) inside the machine except for the time of fixing, while maintaining a sufficient fixing properties (quality) by low thermal energy. For this purpose, the effects of uniformity and spherization of the toner shape may be utilized; however, this is not sufficient.

SUMMARY OF THE INVENTION

In order to solve the above-mentioned problems, the objective of the present invention is to provide a toner which is suitable for practical use without defects such as insufficient cleaning and scattering, and can achieve a stable image-forming performance for a long time, in addition to the advantage of the toner that is formed into a uniform and spherical shape or a shape close to sphericity.

The present invention relates to a toner, comprising;

toner particles containing at least a binder resin and a colorant, and having an average degree of roundness from 0.960 to 1.0 and a standard deviation of degree of roundness of not more than 0.040; and silica particles having an average primary particle size of 16 to 28 nm, in which the number of particles (A) that are less than 15 nm in particle size, the number of particles (B) that are between 15 and 30 nm in particle size and the number of particles (C) that are larger than 30 nm is in relation of B/A>4 and B/C>4.

DETAILED DESCRIPTION OF THE INVENTION

Figure 1:
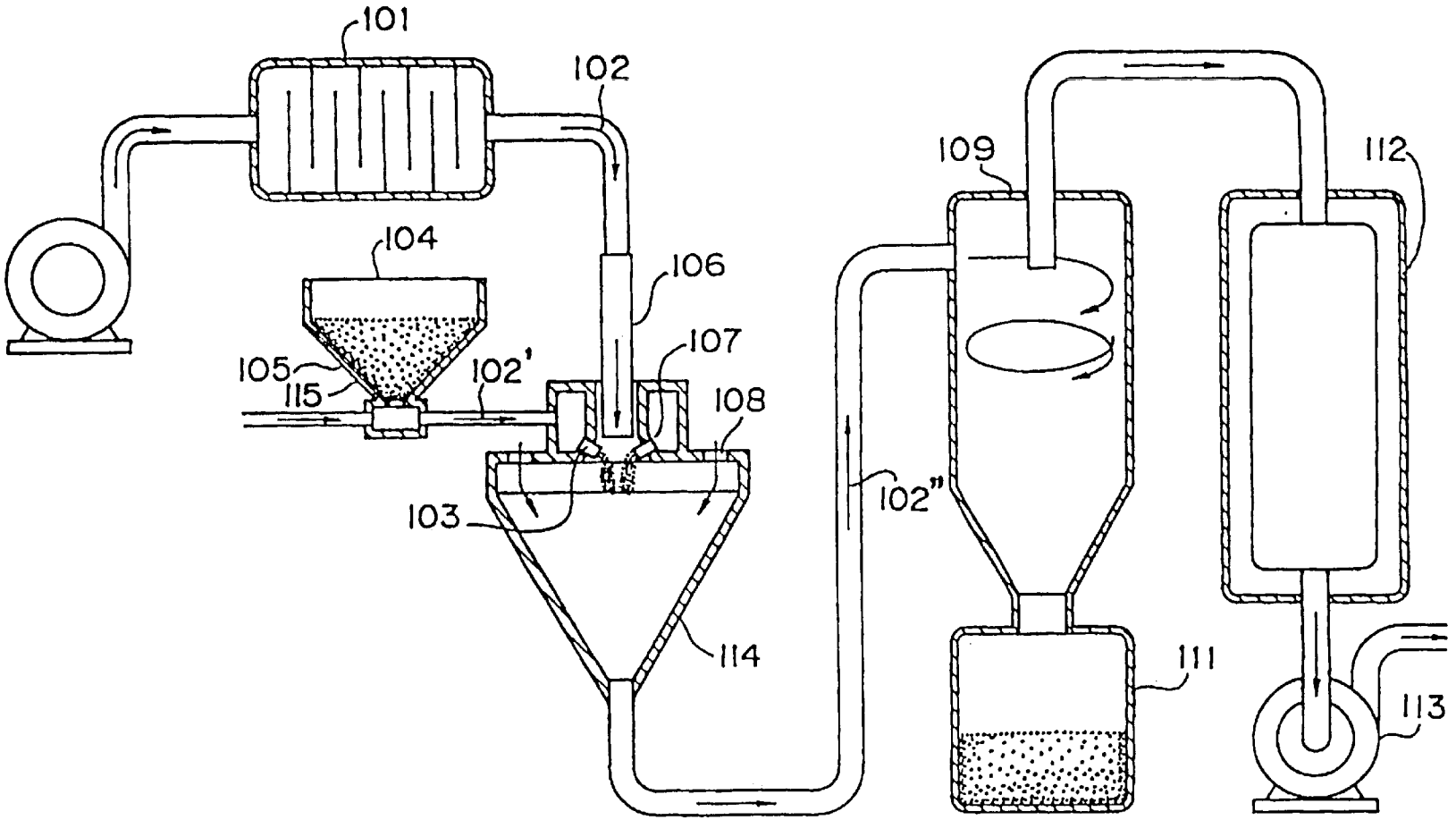
FIG. 1 is a schematic view showing the structure of a device for carrying out an instantaneous heating treatment.

The present invention is characterized by a toner, comprising;

toner particles containing at least a binder resin and a colorant, and having an average degree of roundness from 0.960 to 1.0 and a standard deviation of degree of roundness of not more than 0.040; and silica particles having an average primary particle size of 16 to 28 nm, in which the number of particles (A) that are less than 15 nm in particle size, the number of particles (B) that are between 15 and 30 nm in particle size and the number of particles (C) that are larger than 30 nm is in relation of B/A>4 and B/C>4.

In the toner of the present invention, the surface uniformity is achieved and the irregularity of each toner particle is reduced so that the electrification-build-up properties of the toner are improved. Further, since a sharp distribution in the quantity of electrical charge is achieved, noise such as fogs is reduced so that high quality images can be obtained. Moreover, it is possible to reduce phenomena such as selective developing, etc. (a phenomenon in which toner having a specific particle size or a quantity of electrical charge is first consumed selectively) and consequently to ensure stable toner quality even when copying process is repeated. Furthermore, the use of the toner of the present invention makes it possible to achieve stability and uniformity in the moving properties, etc. (developing and transferring properties), resulting in a wide range of machine-setting conditions.

The toner of the present invention contains at least a binder resin and a colorant. With respect to the binder resin, thermoplastic resins used for binder resins for constituting toners may be used. In the present invention, those resins having a glass transition point of 50 to 70° C. and a softening point of 80 to 160° C. are preferably used.

In particular, those resins having a glass transition point of 50 to 75° C. and a softening point of 80 to 120° C. are preferably used for full color toners.

For toners used for oilless fixing, those resins having a glass transition point of 50 to 75° C. and a softening point of 80 to 160° C. are preferably used.

For magnetic toners, those resins having a glass transition point of 50 to 75° C. and a softening point of 80 to 150° C. are preferably used.

With respect to the toner binder resin component, a polyester resin, which has the above-mentioned characteristics and an acid value of 2 to 50 KOHmg/g, preferably 3 to 30 KOHmg/g, is used. The polyester resin having such an acid value may make it possible to improve the dispersing properties of various pigments including carbon black and charge-control agents, and also to provide a toner having a sufficient quantity of electrical charge. The acid value less than 2 KOHmg/g may reduce the above-mentioned effects. The acid value exceeding 50 KOHmg/g may fail to maintain the stable quantity of electrical charge in toner against environmental fluctuations, in particular, fluctuations in humidity.

With respect to the polyester resin, polyester resins, obtained by polycondensating a polyhydric alcohol component and a polycarboxylic acid component, may be used.

Among polyhydric alcohol components, examples of dihydric alcohol components include: bisphenol A alkylene oxide additives, such as polyoxypropylene(2,2)-2,2-bis(4-hydroxyphenyl)propane, polyoxypropylene(3,3)-2,2-bis(4-hydroxyphenyl)propane, polyoxypropylene(6)-2,2-bis(4-hydroxyphenyl)propane and polyoxyethylene(2,0)-2,2-bis(4-hydroxyphenyl)propane, ethyleneglycol, diethyleneglycol, triethyleneglycol, 1,2-propyleneglycol, 1,3-propyleneglycol, 1,4-butanediol, neopentylglycol, 1,4-butenediol, 1,5-pentanediol, 1,6-hexanediol, 1,4-cyclohexanedimethanol, dipropyleneglycol, polyethyleneglycol, polytetramethyleneglycol, bisphenol A, hydrogenized bisphenol A, etc.

Examples of trihydric or more alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Among polycarboxylic acid components, examples of dihydric carboxylic acid components include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, n-dodecenyl succinic acid, isododecenyl succinic acid, n-dodecyl succinic acid, isododecyl succinic acid, n-octenylsuccinic acid, isooctenyl succinic acid, n-octyl succinic acid, isooctyl succinic acid, and anhydrides or low alkyl esters of these acids.

Examples of trihydric or more carboxylic acid components include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butane tricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, empol trimer acid, anhydrides and low alkyl esters of these acids.

In the present invention, with respect to the polyester resin, a material monomer for a polyester resin, a material monomer for a vinyl resin and a monomer that reacts with both of the resin material monomers are used, and a polycondensating reaction for obtaining a polyester resin and a radical polymerization reaction for obtaining a styrene resin are carried out in parallel in the same container; and resins thus obtained may be preferably used. The monomer that reacts with both of the resin material monomers is, in other words, a monomer that can be used in both a polycondensating reaction and a radical polymerization reaction. That is, the monomer has a carboxyl group that undergoes a polycondensating reaction and a vinyl group that undergoes a radical polymerization reaction. Examples thereof include fumaric acid, maleic acid, acrylic acid, methacrylic acid, etc.

Examples of the material monomers for polyester resins include the above-mentioned polyhydric alcohol components and polycarboxylic acid components.

Examples of the material monomers for vinyl resins include: styrene or styrene derivatives, such as o-methylstyrene, m-methylstyrene, p-methylstyrene, α-methylstyrene, p-ethylstyrene, 2,4-dimethylstyrene, p-tert-butylstyrene and p-chlorostyrene; ethylene unsaturated monoolefins, such as ethylene, propylene, butylene and isobutylene; methacrylic acid alkyl esters, such as methyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-(methyl)butyl methacrylate, hexyl methacrylate, octyl methacrylate, nonyl methacrylate, decyl methacrylate, undecyl methacrylate and dodecyl methacrylate; acrylic acid alkyl esters, such as methyl acrylate, n-propyl acrylate, isopropyl acrylate, n-butyl acrylate, isobutyl acrylate, t-butyl acrylate, n-pentyl acrylate, isopentyl acrylate, neopentyl acrylate, 3-(methyl) butyl acrylate, hexyl acrylate, octyl acrylate, nonyl acrylate, decyl acrylate, undecyl acrylate, and dodecyl acrylate; unsaturated carboxylic acids, such as acrylic acid, methacrylic acid, itaconic acid and maleic acid; acrylonitrile, maleic acid ester, itaconic acid ester, vinyl chloride, vinylacetate, vinylbenzoate, vinylmethylethylketone, vinyl hexyl ketone, vinyl methyl ether, vinyl ethyl ether, and vinyl isobutyl ether. Examples of polymerization initiators used when the material monomers for vinyl resins are polymerized include azo or diazo polymerization initiators such as 2,2'-azobis(2,4-dimethylvaleronitrile, 2,2'-azobisisobutyronitrile, 1,1'-azobis(cyclohexane-1-carbonitrile) and 2,2'-azobis-4-methoxy-2,4-dimethylvaleronitrile and peroxide polymerization initiators such as benzoyl peroxide, methyl ethyl ketone peroxide, isopropylperoxycarbonate and lauroyl peroxide.

In the present invention, in order to improve the fixing properties of toners for oil-less fixing as well as improving the anti-offset properties, or in order to control the gloss properties for images in full-color toners requiring a light-transmitting properties, it is preferable to use two kinds of binder resins having different softening points as its binder resins. The first resin having a softening point of 80 to 125° C. is used so as to improve the fixing properties of toners for oil-less fixing, and the second resin having a softening point of 125 to 160° C. is used so as to improve the anti-offset properties. In this case, if the softening point of the first resin is lower than 80° C., the anti-offset properties are reduced and the reproducibility of dots is reduced. The softening point exceeding 125° C. fails to provide sufficient effects for improving the fixing properties. If the softening point of the second resin is lower than 125° C., the effects for improving the anti-offset properties become insufficient. The softening point exceeding 160° C. reduces the fixing properties. For this reason, the softening point of the first resin is preferably from 95 to 125° C., more preferably from 100 to 115° C. and the softening point of the second resin is preferably 130 to 160° C., more preferably from 135 to 155° C. It is desirable that the glass transition points of the first and second resins are preferably from 50 to 75° C., more preferably from 55 to 70° C. This is because, when the glass transition point is too low, the heat resistance of toner becomes insufficient and when it is too high, the pulverization properties during manufacturing processes is reduced, resulting in a low production efficiency. It is desirable that the softening point of the second resin is 10° C. or more, preferably 15° C. or more higher than that of the first resin.

With respect to the first and second resins, the polyester resins and the vinyl resins as above mentioned may be used.

A weight ratio of the first resin and the second resin is set at 7:3 to 2:8, preferably 6:4 to 3:7. The use of the first resin and the second resin in such a range provides a superior dot-reproducibility with less toner's expansion due to crushing at the time of fixing and a superior low-temperature fixing properties. Good fixing properties both in high-speed and low-speed image-forming apparatuses may also be ensured. Moreover, it is possible to ensure a superior dot-reproducibility even in double-sided image-forming processes (in which two passages are made through the fixing device). The ratio of the first resin less than the above-mentioned range makes the low-temperature fixing properties insufficient, and fails to ensure a wide range of fixing properties. The ratio of the second resin less than the above-mentioned range tends to reduce the anti-offset properties and cause toner's expansion due to crushing at the time of fixing, resulting in degradation in the dot-reproducibility.

In the full-color process requiring light-transmitting properties, resins of a sharply-melting type, which have a sharp molecular weight distribution, are conventionally used. The use of such type of resins makes it possible to reproduce glossy and pictorial images. However, in recent years, in color copying normally used in offices, there are increasing demands for images with less degree of gloss. In order to meet such demands, for example, the molecular weight distribution of the resin is widened to the high-molecule side. One of the specific methods for this is to use two or more kinds having different molecular weights in a combined manner. When the resin thus obtained finally through the combination has a glass transition point of 50 to 75° C., a softening point of 80 to 120° C., a number-average molecular weight of 2,500 to 30,000 and a ratio of weight-average molecular weight/number-average molecular weight in the range of 2 to 20, it is preferably adopted. When copied images are desired to have less gloss, the value of the ratio of weight-average molecular weight/number-average molecular weight is set at not less than 4 so that the melt-viscosity curve is tilted. Thus, it becomes possible to expand the gloss-degree controlling-range with respect to the fixing temperature.

Epoxy resins may be preferably used, in particular, in full-color toners. Examples of epoxy resins preferably used in the present invention include polycondensated products of bisphenol A with epichlorohydrin. For example, Epomic R362, R364, R365, R367, R369 (made by Mitsui Sekiyukagaku K.K.), Epotot YD-011, YD-012, YD-014, YD-904, YD-017 (made by Touto Kasei K.K.) and Epi Coat 1002, 1004, 1007 (made by Shell Kagaku K.K.) are commercially available.

In the present invention, the softening point of resins are measured by a flow tester (CFT-500: made by Shimadzu Seisakusho K.K.) in which: 1 $cm^3$ of a sample was melted and flowed under the conditions of a thin pore of die (diameter 1 mm, length 1 mm), an applied pressure of 20 $kg/cm^2$ and a temperature-rising rate of 6° C./min, and the temperature corresponding to ½ of the height from a flowing start point to a flowing terminal point was defined as the softening point. The glass transition point is measured by a differential scanning calorimeter (DSC-200: made by Seiko Denshi K.K.) in which: based upon alumina as the reference, 10 mg of a sample was measured under the conditions of a temperature-rising rate of 10° C./min and at temperatures ranging from 20 to 120° C. , and the shoulder value of the main heat-absorption peak was defined as the glass transition point. With respect to the acid value, 10 mg of a sample was dissolved in 50 ml of toluene, and this was titrated by a solution of N/10 potassium hydroxide/alcohol that had been preliminarily standardized, in the presence of a mixture indicator of 0.1% of bromo-thymol blue and phenol red. The value was calculated from an amount of consumption of the solution of N10 potassium hydroxide/alcohol. The molecular weight (number-average molecular weight, weight-average molecular weight) were obtained by the gel-permeation chromatography (GPC) method and converted based upon styrene.

In order to improve the anti-offset properties, etc., the toner of the present invention may contain a wax. Examples of such a wax include polyethylene wax, polypropylene wax, carnauba wax, rice wax, sazol wax, montan ester waxes, Fischer-Tropsch wax, etc. In the case of addition of a wax to the toner, the content is preferably in the range of 0.5 to 5 parts by weight relative to 100 parts by weight of the binder resin. Thereby, it becomes possible to obtain the effects of the addition without causing disadvantages, such as filming, etc.

From the viewpoint of improvement in anti-offset properties, polypropylene wax is preferably contained. From the viewpoint of improvements in smear-preventive properties ("smear" means a phenomenon in which, when a paper-sheet with images copied on its one side is fed by an automatic document-feeding apparatus or in a double-sided copying machine, degradation in the copied image, such as blurring and stains, occurs due to friction between the sheets or between the sheet and rollers on the image), polyethylene wax is preferably contained. From the above-mentioned view points, the polypropylene wax is preferably set to have a melt viscosity of 50 to 300 cps at 160° C., a softening point of 130 to 160° C. and an acid value of 1 to 20 KOH mg/g. The polyethylene wax is more preferably set to have a melt viscosity of 1,000 to 8,000 cps at 160° C. and a softening point of 130 to 150° C. The polypropylene wax having the above-mentioned melt viscosity, softening point and acid value exhibits a superior dispersing properties to the binder resin. The anti-offset properties are improved without causing problems due to isolated wax. In particular, when polyester resin is used as the binder resin, oxidized-type waxes are preferably used.

Examples of waxes of oxidized type include oxidized polyolefin waxes, carnauba wax, montan wax, rice wax, and Fischer-Tropsch wax, etc.

With respect to polypropylene waxes which are polyolefin waxes, low molecular weight polypropylene has a small hardness to cause the defect of lowering the toner fluidity. It is preferable that those waxes are modified with carboxylic acid or acid anhydride in order to improve the above defects. In particular, modified polypropylene resins in which a low molecular polypropylene resin is modified with one or more kinds of acid monomers selected from the group consisting of (metha)acrylate, maleic acid and maleic acid anhydride, are preferably used. Such a modified polypropylene may be obtained, for example, by subjecting a polypropylene resin to a graft or addition reaction with one or more kinds of acid monomers selected from the group consisting of (metha) acrylate, maleic acid and maleic acid anhydride in the presence of a peroxide catalyst or without a catalyst. When the modified polypropylene is used, the acid value is set in the range of 0.5 to 30 KOHmg/g, preferably 1 to 20 KOHmg/g.

With respect to the oxidized-type polypropylene waxes, Viscol 200TS (softening point 140° C., acid value 3.5), Viscol 100TS (softening point 140° C., acid value 3.5), Viscol 110TS (softening point 140° C., acid value 3.5), each of which is made by Sanyo Kasei Kogyo K.K., etc., are commercially available.

With respect to oxidized-type polyethylene, commercially available products are: San Wax E300 (softening point 103.5° C., acid value 22) and San Wax E250P (softening point 103.5° C., acid value 19.5), made by Sanyo Kasei Kogyo K.K.; Hi-Wax 4053E (softening point 145° C., acid value 25), 405MP (softening point 128° C., acid value 1.0), 310MP (softening point 122° C., acid value 1.0), 320MP (softening point 114° C., acid value 1.0), 210MP (softening point 118° C., acid value 1.0), 220MP (softening point 113° C., acid value 1.0), 4051E(softening point 120° C., acid value 12), 4052E(softening point 115° C., acid value 20), 4202E (softening point 107° C., acid value 17) and 2203A (softening point 111° C., acid value 30), made by Mitsui Sekiyukagaku K.K., etc.

When carnauba wax is used, the ones of fine crystal particles are preferably used with their acid value preferably in the range of 0.5 to 10 KOHmg/g, preferably 1 to 6 KOHmg/g.

Montan waxes generally refer to montan ester waxes refined from minerals, being in the form of fine crystals as well as carnauba wax; the acid value thereof is preferably in the range of 1 to 20, and more preferably, 3 to 15.

Rice wax is obtained by air-oxidizing rice bran wax, and its acid value being preferably in the range of 5 to 30 KOHmg/g.

Fischer-Tropsch wax is a wax that is produced as a by-product when synthetic oil is produced from coal according to the hydrocarbon-synthesizing method. Such a wax, for example, is available as trade name "sazol wax" made by Sazol K.K. Fischer-Tropsch wax, made from natural gas as a starting material, may be preferably used since it contains less low molecular weight ingredients and exhibits a superior heat resistance when used with toner.

With respect to the acid value of Fischer-Tropsch wax, those having an acid value of 0.5 to 30 KOHmg/g may be used. Among sazol waxes, those of oxidized type having an acid value of 3 to 30 KOHmg/g (trade name: sazol wax A1, A2, etc.) are, in particular, preferably used. Polyethylene wax having the above-mentioned melt viscosity and softening point also exhibits a superior dispersing properties to the binder resin, thereby improving the smear-preventive properties because frictional coefficient of the surface of a fixed image is reduced without causing problems due to isolated wax. The melt viscosity of wax was measured by a viscometer of the Brook Field type.

Known pigments and dyes are used as colorants for full-color toner. Examples of them include carbon black, aniline blue, chalcoil blue, chrome yellow, ultramarine blue, DuPont Oil Red, quinoline yellow, methylene blue chloride, copper phthalocyanine, Malachite green oxalate, Lump Black, Rose Bengal, C.I. Pigment Red 48:1, C.I. Pigment Red 122, C.I. Pigment Red 57:1, C.I. Pigment Red 184, C.I. Pigment Yellow 97, C.I. Pigment Yellow 12, C.I. Pigment Yellow 17, C.I. Solvent Yellow 162, C.I. Pigment Yellow 180, C.I. Pigment Yellow 185, C.I. Pigment Blue 15:1, C.I. Pigment Blue 15:3, etc. With respect to black toner, various kinds of carbon black, active carbon and titanium black may be used. The colorant may be replaced partially or all with a magnetic material. For such a magnetic material, for example, known magnetic fine particles such as ferrite, magnetite and iron, may be used. In order to achieve sufficient dispersing properties at the production time, an average particle size of the magnetic particles is preferably not more than 1 $\mu$m, preferably not more than 0.5 $\mu$m. In the case of the addition so as to prevent toner-scattering while maintaining the characteristics required for the non-magnetic toner, an amount of addition is in the range of 0.5 to 10 parts by weight, preferably 0.5 to 8 parts by weight, more preferably 1 to 5 parts by weight with respect to 100 parts by weight of the binder resin. If the amount of addition exceeds 10 parts by weight, magnetic restraint force of the developer-supporting member (in which a magnet roller is installed) to the toner gets strong to cause degradation in the developability.

When used as magnetic toner, a magnetic material is preferably contained in the range of 20 parts by weight to 60 parts by weight with respect to 100 parts by weight of the binder resin. The amount of addition of not more than 20 parts by weight tends to increase toner-scattering. The amount exceeding 60 parts by weight fails to maintain stable quantity of electrical charge of toner, resulting in degradation in the image quality.

In the toner of the present invention, additive agents such as a charge-control agent and a mold-releasing agent may be added to its binder resin depending on various purposes. For example, for the charge-control agent, the following compounds may be added: a fluorine surface-active agent, a metal-containing dye such as a metal complex of salicylic acid and an azo-series metal compound, a high molecular acid such as a copolymer containing maleic acid as a monomer component, a quaternary ammonium salt, an azine dye such as nigrosine, carbon black, etc. Magnetic particles, etc. may also be added to the toner of the present invention, if necessary.

In the toner of the present invention, it is preferably to add various organic/inorganic fine particles as fluidity-adjusting agents before a surface-modifying process and/or after a toner-particle preparation. Examples of the inorganic fine particles include various kinds of carbides, such as silicon carbide, boron carbide, titanium carbide, zirconium carbide, hafnium carbide, vanadium carbide, tantalum carbide, niobium carbide, tungsten carbide, chromium carbide, molybdenum carbide, calcium carbide and diamond carbon lactam; various nitrides such as boron nitride, titanium nitride and zirconium nitride; bromides such as zirconium bromide; various oxides, such as titanium oxide, calcium oxide, magnesium oxide, zinc oxide, copper oxide, aluminum oxide, silica and colloidal silica; various titanic acid compounds, such as calcium titanate, magnesium titanate and strontium titanate; sulfides such as molybdenum disulfide; fluorides such as magnesium fluoride and carbon fluoride; various metal soaps, such as aluminum stearate, calcium stearate, zinc stearate and magnesium stearate; and various nonmagnetic inorganic fine particles such as talc and bentonite. These materials may be used alone or in combination. In particular, it is preferable that the inorganic fine particles such as silica, titanium oxide, alumina and zinc oxide are treated by a known method with a conventionally used hydrophobisizing agent, such as a silane coupling agent, a titanate coupling agent, silicone oil and silicone vanish, or with a treatment agent, such as a fluorine silane coupling agent or fluorine silicone oil, a coupling agent having an amino group or a quaternary aluminum salt group, and a modified silicone oil.

With respect to the organic fine particles, various organic fine particles, such as styrene particles, (metha)acrylic particles, benzoguanamine, melamine, Teflon, silicon, polyethylene and polypropylene, which are formed into particles by a wet polymerization method such as an emulsion polymerization method, a soap-free emulsion polymerization method and a non-aqueous dispersion polymerization method, and a vapor phase method, etc, may be used. These organic fine particles also works as a cleaning-assist agent.

Inorganic fine particles, such as titanate metal salts, having a comparatively large particle size, and various organic fine particles may be, or may not be subjected to a hydrophobic treatment.

Among the above-mentioned fine particles, hydrophobic silica is preferably used as the inorganic fine particles to be added prior to a heat treatment which will be described later. Preferable silica particles are the ones having an average primary particle size (peak value) of 16 to 28 nm, in which the number of particles (A) that are less than 15 nm in particle size, the number of particles (B) that are between 15 and 30 nm in particle size and the number of particles (C) that are larger than 30 nm is in relation of B/A>4 and B/C>4. More preferable silica particles are the ones having an average primary particle size (peak value) of 18 to 25 nm and relation of B/A>5 and B/C>5. Particularly preferable silica particles are the ones having an average primary particle size (peak value) of 18 to 25 nm and relation of B/A>6 and B/C>6.

By using the inorganic fine particles having the above-mentioned particle size distribution, the silica as above mentioned is allowed to sufficiently form a stopping layer (a blocking effect) in the cleaning section especially in the case of use of a cleaning blade, thereby preventing unswept toner through the cleaning blade and residual toner after sweeping. These particles uniformly adhere to any toner particle so that the stopping layer is formed stably. In general, they themselves have not so high fluidity compared with fine inorganic particles of small particle size. Therefore, it is thought that an appropriate frictional force with respect to the photosensitive member is maintained.

The above-mentioned inorganic fine particles adhere uniformly to coat toner-surface and work to provide an appropriate toner-to-toner distance (a spacer effect), and also make it possible to provide a sufficient heat resistance even to toner of a low viscosity type, together with the effect of the toner spherical shape that reduces the surface area and eliminates partial high-contact portions such as angulating portions peculiar to irregular-shaped toner.

The inorganic fine particles having the above-mentioned particle-size distribution reduces the adhesive properties to parts or members, etc. (spacer effect), and provides not a (frictionless) fluidity such as given by small-size silica, but a more shaggy fluidity (effect to reduce the fluidity). Therefore, it is possible to adjust the high fluidity of the spherical toner in an appropriate area (range). Thus, it becomes possible to prevent scattering without reducing the effects of the spherical toner (high quality without image losses, high transferring efficiency). Furthermore, since the fluidity is appropriately adjusted, a good handling performance in the machine is obtained, and superior sealing properties and other properties are achieved.

The above-mentioned fine particles may be used either before or after a toner surface-modifying process (a heating treatment). However, it is more effective to use these particles prior to the heating treatment which will be discussed later. When subjected to the heat treatment, the fine particles are fixed on the surface of toner particles.

This is because these fine particles can sufficiently exist on the toner surface even under the heating treatment, and provide fine irregularities on the toner surface without impairing the effects of the present invention; therefore, also in the case where other external additive agents are added, it is possible to easily carry out the post-treatment uniformly, and also to provide a superior dispersing properties and a stable quantitative supplying properties during the heating treatment.

With respect to the particle size of the inorganic fine particles, a distribution of diameters of 3,000 to 5,000 particles is taken based upon electron microscope photographs of the particles, and the arithmetic average of the diameters of the respective particles is defined as the average primary particle size.

The above-mentioned binder resin, colorants, and other desired additive agents are mixed, kneaded, pulverized and classified by conventional methods so as to obtain particles having a desired particle size. In the present invention, the particles thus obtained are subjected to an instantaneous heating treatment.

The particle size is set in the range of 4 to 10 $\mu$m, preferably 5 to 9 $\mu$m. The particles, obtained at this stage, have virtually the same particle size distribution even after the instantaneous heating treatment.

The classifying process may be carried out after the instantaneous heating treatment of the present invention. It is preferable to use a granulator which allows the pulverized particles to have a spherical shape as a pulverizer used in the pulverizing process. The instantaneous heating treatment, which is to be carried out successively, can be controlled more easily. Examples of such a device include an Inomizer System (made by Hosokawa Micron K.K.), a Criptron System (made by Kawasaki Jyukogyo K.K.), etc. As a classifier used in the classifying process, it is preferable to use such a classifier as to allow the processed particles to have a spherical shape. This makes it easier to control the degree of roundness, etc. Examples of such a classifier include a Teeplex Classifier (made by Hosokawa Micron K.K.).

The instantaneous heating treatment of the present invention may be carried out in combination with various processes in surface-modifying devices for various developers. Examples of these surface-modifying devices include surface-modifying devices using the high-speed gas-flow impact method, such as Hybridization System (made by Narakikai Seisakusho K.K.), a Criptron Cosmos System (made by Kawasaki Jyukogyo K.K.) and an Inomizer System (made by Hosokawa Micron K.K.), surface-modifying devices using the dry mechanochemical method, such as a Mechanofusion System (made by Hosokawa Micron K.K.) and a Mechanomill (made by Okadaseikou K.K.), and surface-modifying devices in which the wet coating method is applied, such as a Dispacoat (made by Nisshin Engineering K.K.) and Coatmizer (made by Freund Sangyo K.K.). And these devices may be used appropriately in a combined manner.

In the present invention, the instantaneous heating treatment controls the toner particles obtained through the kneading-pulverizing method so as to have a uniform spherical shape, reduces fine pores appearing on the surface of the toner, and increases smoothness. This makes it possible to provide a toner which is superior in uniformity in charging and in image-forming performance, eliminates phenomena such as selective developing in which toner having specific particle size, shape and ingredient in the developer and a specific quantity of charge is first consumed selectively, and achieves a stable image-forming performance for a long time.

Even when applied as a small-particle-size toner which contains as its main component a low-softening-point binder resin that is suitable for a high image-quality, low consumption (coloring material is highly-filled) and a low-energy fixing system, those properties being highly demanded in recent years, and which contains a coloring material at high filing-rate, the toner of the present invention exhibits an appropriate adhesive properties to the toner-supporting members (carrier, developing sleeves, developer rollers, etc.), the photosensitive member and the transferring members, and also has a superior moving properties. Fluidity is excellent, uniformity in electrical charge is improved, and a stable durability is ensured for a long time. In the case of a magnetic toner, the application of such an instantaneous heating treatment allows the binder resin in the magnetic particles to melt and provide spherical shape, eliminates magnetic particles being exposed to the surface, and fix isolated fine particles on the surface of the magnetic particles.

More specifically, an average degree of roundness is set at not less than 0.960, preferably in the range of 0.960 to 0.995, and a standard deviation of degree of roundness is set at not more than 0.040, preferably not more than 0.035.

In the present description, the average degree of roundness is the average value of values calculated by the following equation:

$$\text{(Average degree of roundness)} = \frac{\text{(Peripheral length of a circle equal to projection area of a particle)}}{\text{Peripheral length of a particle projection image}}$$

in which "Peripheral length of a circle equal to projection area of a particle" and "Peripheral length of a particle projection image" are represented by values obtained through measurements carried out by using a flow-type particle image analyzer (FPIA-1000 or FPIA-2000; made by Toa Iyoudenshi K.K.) in an aqueous dispersing system. The closer the value to 1, the closer the shape to sphere. Since the average degree of roundness is obtained by "Peripheral length of a circle equal to projection area of a particle" and "Peripheral length of a particle projection image", the resulting value provides an index that correctly reflects irregular conditions of the surfaces of particles. Because the average degree of roundness is a value obtained as an average value with respect to 3,000 particles, the reliability of the degree of roundness of the present invention is very high. In the present description, the average degree of roundness is not necessarily measured by the above-mentioned apparatus, and any apparatus may be used, as long as it is capable of carrying out the measurements based upon the above-mentioned equation in principle.

The standard deviation of the degree of roundness indicates the standard deviation in the distribution of the degree of roundness, and this value is obtained together with the average degree of roundness at the same time by the above-mentioned flow-type particle image analyzer. The smaller the value, the more uniform the toner particle shapes are.

The instantaneous heating treatment used in the present invention is carried out by spraying and dispersing toner particles into a hot air by using compressed air. The developer is surface-modified by heat. A high degree of roundness and homogeneity that have not been achieved by conventional methods can be achieved.

Figure 2:
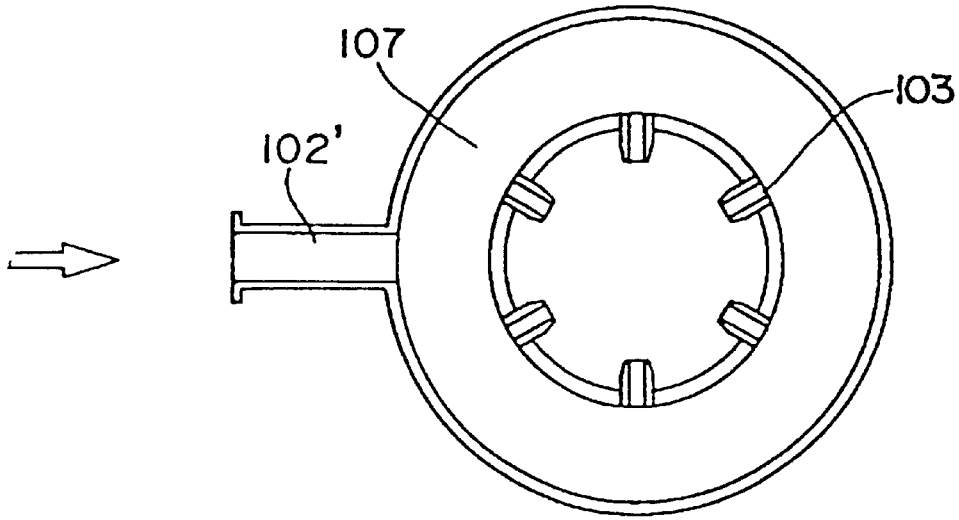
FIG. 2 is a horizontal cross-sectional view that schematically shows a sample-discharging chamber in the device of FIG. 1.

Referring to schematic views of FIGS. 1 and 2, the following description will discuss the construction of a device that carries out the instantaneous heating treatment.

As illustrated in FIG. 1, high-temperature, high-pressure air (hot air), formed in a hot-air generating device 101, is ejected by a hot-air jetting nozzle 106 through an induction pipe 102. Toner particles 105 are transported by a predetermined amount of pressurized air from a quantitative supplying device 104 through an induction pipe 102', and fed to a sample-ejecting chamber 107 installed around the hot-air ejecting nozzle 106.

As illustrated in FIG. 2, the sample-ejecting chamber 107 has a hollow doughnut shape, and a plurality of sample-ejecting nozzles 103 are placed on its inside wall with the same intervals. The toner particles, sent to the sample-ejecting chamber 107, are allowed to spread inside the ejecting chamber 107 in a uniformly dispersed state, and discharged through the sample-ejecting nozzles 103 into thehot air flow by the pressure of air successively sent thereto.

It is preferable to provide a predetermined tilt to the sample-ejecting nozzles 103 so as not to allow the discharging flow from each sample-ejecting nozzle 103 to cross the hot air flow. More specifically, the ejection is preferably made so that the toner-ejecting flow runs along the hot air flow to a certain extent. An angle formed by the toner ejecting flow and the direction of the central flow of the hot air flow is preferably set in the range of 20 to 40°, preferably 25 to 35°. The angle wider than 400 causes the toner ejecting flow to cross the hot air flow, resulting in collision with toner particles discharged from other nozzles and the subsequent aggregation of the toner particles. The angle narrower than 20° left some toner particles not being taken in the hot air flow, resulting in irregularity in the toner particle shape.

A plurality of the sample-ejecting nozzles 103, preferably at least not less than 3, more preferably not less than 4 are required. The use of a plurality of the sample-ejecting nozzles makes it possible to uniformly disperse the toner particles into the hot air flow, and to ensure a heating treatment for each of the toner particles. With respect to the ejected state from the sample-ejected nozzle, it is desirable that the toner particles are widely scattered at the time of ejection and dispersed to the entire hot air flow without collision with other toner particles.

The toner particles, thus ejected, are allowed to contact with the high-temperature hot air instantaneously, and subjected to a heating treatment uniformly. "Instantaneously" refers to a time period during which a required toner-particle improvement (heating treatment) has been achieved without causing aggregation between the toner particles; and although it depends on the processing temperature and the density of toner particles in the hot air flow, this time period is normally set at not more than 2 seconds, preferably not more than 1 second. This instantaneous time period is represented as a residence time of toner particles from the time when the toner particles are ejected from the sample-ejecting nozzles to the time when they are transported into the induction pipe 102". The residence time exceeding 2 seconds is likely to cause bonding of particles.

The toner particles, which have been instantaneously heated, are cooled off by a cold air flow introduced from a cooling-air induction section 108, and collected into a cyclone 109 through the induction pipe 102" without adhering to the device walls and causing aggregation between particles, and then stored in a production tank 111. The carrier air from which the toner particles have been removed is allowed to pass through a bug filter 112 by which fine powder is removed therefrom, and released into the air through a blower 113. The cyclone 109 is preferably provided with a cooling jacket through which cooling water runs, so as to prevent aggregation of toner particles.

In addition, important conditions for carrying out the instantaneous heating treatment include an amount of hot air, an amount of dispersing air, a dispersion density, a processing temperature, a cooling air temperature, an amount of suction air and a cooling water temperature.

The amount of hot air refers to an amount of hot air supplied by the hot-air generating device 101. The greater the amount of hot air, the better in an attempt to improve the homogeneity of the heating treatment and the processing performance.

The amount of dispersing air refers to an amount of air that is to be sent to the induction pipe 102' by the pressurized air. Although it also depends on other conditions, the amount of dispersing air is preferably suppressed during the heating treatment. Dispersing state of toner particles are improved and stabilized.

The dispersion density refers to a dispersion density of toner particles in a heating treatment area (more specifically, a nozzle-jetting area). A preferable dispersion density varies depending on the specific gravity of toner particles; and the value obtained by dividing the dispersion density by the specific gravity of toner particles is preferably set in the range of 50 to 300 g/m$^3$, preferably 50 to 200 g/m$^3$.

The processing temperature refers to a temperature within the heating treatment area. In the heating treatment area, a temperature gradient spreading outwards from the center actually exists, and it is preferable to reduce this temperature distribution at the time of the heating treatment. It is preferable from the viewpoint of device mechanism to supply an air flow in a stable layer-flow state by using a stabilizer, etc. In the case of a non-magnetic toner containing a binder resin having a sharp molecular-weight distribution, for example, a binder resin having a ratio of weight-average molecular weight/number-average molecular weight of 2 to 20, it is preferable to carry out the heating treatment in a peak-temperature range between the glass transition point of the binder resin+100° C. and the glass transition point thereof+300° C. It is more preferable to carry it out in a peak-temperature range between the glass transition point of the binder resin+120° C. and the glass transition point thereof+250° C. The peak temperature range refers to a maximum temperature in the area in which the toner contacts with the hot air.

In the case of a non-magnetic toner containing a binder resin having a relatively wide molecular-weight distribution, for example, a binder resin having a ratio of weight-average molecular weight/number-average molecular weight of 30 to 100, it is preferable to carry out the heating treatment in a peak-temperature range between the glass transition point of the binder resin+100° C. and the glass transition point thereof+300° C. It is more preferable to carry it out in a peak-temperature range between the glass transition point of the binder resin+150° C. and the glass transition point thereof+280° C. The reason for this is that, in order to improve the shape and surface homogeneity of the toner, it is necessary to apply a high processing temperature so that even the high molecular portion of the binder resin can be modified. However, the setting of the high processing temperature, in contrast, tends to produce bonded particles; therefore, some adjustment of conditions may be required. For example, an amount of a fluidizing agent prior to the heating treatment has to be set higher, or the dispersion density is set lower at the time of the treatment, etc.

When wax is added to the toner particles, particles are more likely to bond. For this reason, some adjustment of conditions may be required. For example, an amount of a fluidizing agent (especially, fluidizing agent having a large particle size) prior to the heating treatment is set higher. The dispersion density is set lower at the time of the treatment, etc. These adjustments are significant to obtain-uniform toner particles with shape-irregularity suppressed. These operations are particularly important when a binder resin having a relatively wide molecular weight distribution is used or when the processing temperature is set to a high level in order to heighten the degree of roundness.

The cooling air temperature refers to a temperature of cold air introduced from the cooling-air introduction section 108. The toner particles, after having been subjected to an instantaneous heating treatment, are preferably placed in an atmosphere of a temperature not more than the glass transition point by using cold air so as to be cooled to a temperature range which causes no aggregation or bonding of the toner particles. Therefore, the temperature of the cooling air is set at not more than 25° C., preferably not more than 15° C., more preferably not more than 10° C. However, an excessively lowered temperature might cause dew condensation in some conditions and adverse effects; this must be noted. In the instantaneous heating treatment according to the invention, together with a cooling effect by cooling water in the device as will be described next, since the time in which the binder resin is in a fused state is kept very short, it is possible to eliminate aggregation between the particles and adhesion of the particles to the device walls of the heat treatment device. Consequently, it becomes possible to provide superior stability even during continuous production, to greatly reduce the frequency of cleaning for the manufacturing devices, and to stably maintain the yield high.

The amount of suction air refers to air used for carrying the processed toner particles to the cyclone by the blower 113. The greater the amount of suction air, the better in reducing the aggregation of the toner particles.

The temperature of cooling water refers to the temperature of cooling water inside the cooling jacket installed in the cyclones 109 and 114 and in the induction pipe 102". The temperature of cooling water is set at not more than 25° C., preferably not more than 15° C., more preferably not more than 10° C.

In order to maintain a high degree of sphericity (degree of roundness) and to reduce irregularity in shape, it is preferable to further take the following measures.

(1) The amount of toner particles to be supplied to the hot air flow is kept constant without generating pulsating movements, etc. For this purpose;

(i) a plurality of devices, such as a table feeder 115 shown in FIG. 1 and a vibration feeder, are used in combination so as to improve the quantitative supplying properties. If a high-precision quantitative supply is achieved by using a table feeder and a vibration feeder, finely-pulverizing and classifying processes can be connected thereto so that toner particles can be supplied on-line to the heating treatment process;

(ii) After having been supplied by compressed air, prior to supplying toner particles into hot air, the toner particles are re-dispersed inside the sample-supplying chamber 107 so as to enhance the dispersion uniformity. For example, the following measures are adopted: the re-dispersion is carried out by using secondary air; the dispersed state of the toner particles is uniformed by installing a buffer section; and the re-dispersion is carried out by using a co-axial double tube nozzle, etc.

(2) When sprayed and supplied into a hot air flow, the dispersion density of the toner particles is optimized and controlled uniformly. For this purpose;

(i) the supply into the hot air flow is carried out uniformly, in a highly dispersed state, from all circumferential directions. More specifically, in the case of supply from dispersion nozzles, those nozzles having a stabilizer, etc. are adopted so as to improve the dispersion uniformity of the toner particles that are dispersed from each of the nozzles;

(ii) In order to uniform the dispersion density of the toner particles in the hot air flow, the number of nozzles is set to at least not less than 3, preferably not less than 4, as described earlier. The greater the number, the better, and these nozzles are arranged symmetrically with respect to all the circumferential directions. The toner particles may be supplied uniformly from slit sections installed all the 360-degree circumferential areas;

(3) Control is properly made so that no temperature distribution of the hot air is formed in the processing area of toner particles so as to apply uniform thermal energy to each of the particles, and the hot air is maintained in a layer-flow state. For this purpose;

(i) the temperature fluctuation of a heating source for supplying hot air is reduced.

(ii) A straight tube section preceding the hot-air supplying section is made as long as possible. Alternatively, it is preferable to install a stabilizer in the vicinity of the hot-air supplying opening so as to stabilize the hot air. Moreover, the device construction, shown in FIG. 1 as an example, is an open system; therefore, since the hot air tends to be dispersed in a direction in which it contacts outer air, the supplying opening of the hot air may be narrowed on demands.

(4) The toner particles are subjected to a sufficient fluidizing treatment so as to be maintained in a uniform dispersed state during the heating treatment. For this purpose, (i) in order to maintain sufficient dispersing and fluidizing properties of the toner particles, it is preferable to use inorganic fine particles having an average primary particle size (peak value) in the range of 5 to 15 nm, preferably 5 to 12 nm. In particular, it is preferable to use hydrophobic silica or titania fine particles. An amount of addition is 0.3 to 5 parts by weight, preferably 0.5 to 3 parts by weight, with respect to 100 parts by weight of the toner particles;

(ii) In a mixing process for improving the dispersing and fluidizing properties, each of the fine particles is preferably located on the surface of the toner particle uniformly in an adhering state without being firmly fixed thereon.

(5) Even when the surface of the toner particle is subjected to heat, particles which have not been softened are located on the surface of the toner particle so that a spacer effect is maintained between the toner particles. For this purpose;

(i) it is preferable to use hydrophobic silica particles having an average primary particle size (peak value) in the range of 16 to 28 nm, in which the number of particles (A) that are less than 15 nm in particle size, the number of particles (B) that are between 15 and 30 nm in particle size and the number of particles (C) that are larger than 30 nm is in relation of $B/A>4$ and $B/C>4$. The existence of the fine particles on the surface of the toner particle prevents the toner particle surface from forming a surface entirely made from the resin component even after heat is started to be applied, thereby providing the spacer effect between the toner particles and also preventing aggregation and bonding between the toner particles. The combination use of the hydrophobic silica with the fine inorganic particles is preferable from the viewpoint of the surface coating.

(ii) The above hydrophobic silica is added in an amount of 0.3 to 3 parts by weight, preferably 0.5 to 2.5 parts by weight.

(6) The collection of the heat-treated product is controlled so as not to generate heat. For this purpose;

(i) the particles that are subjected to the heat treatment and cooling process are preferably cooled in a chiller in order to reduce heat generating in the piping system (especially, in R portions) and in the cyclone normally used in the collection of the toner particles.

(7) In the case of a process using magnetic toner having a relatively greater specific gravity with a small amount of resin component that contributes to the heating treatment, it is preferable to surround the heat-treating space in a cylinder shape so as to increase the time during which the treatment is virtually carried out, or to carry out a plurality of the treatments.

The above description has dealt with the shape control of particles obtained by the kneading and pulverizing method with respect to toner particles. However, the present invention is applicable to any toner as long as it has the above-mentioned average degree of roundness and the distribution of the degree of roundness. For example, those toners obtained by the wet granulation method (emulsion polymerization method, suspension polymerization method, etc.) may also be used.

External additive agents are added to the toner particles obtained as described above. With respect to the external additive agents, inorganic fine particles that are the same as those added prior to the heating treatment, such as, silica, titanium oxide, alumina, zinc oxide and strontium titanate, or organic fine particles, may be used. An amount of addition is set in the range of 0.3 to 5 parts by weight, preferably 0.5 to 3 parts by weight with respect to 100 parts by weight of the toner particles. It is preferable to appropriately adjust the amount of addition before and after the heating treatment. Among these fine particles, metal salts of titanic acid having a relatively large particle size can be used without a hydrophobic treatment. However, it is preferable that the surface thereof are preferably treated hydrophobicaly with silane coupling agents, etc.

Desirable external additive agent are inorganic fine particles having a primary particle size of 5 to 30 nm, preferably 5 to 25 nm from the viewpoint of improvement of fluidity of toner particles.

From the viewpoint of environmental stability of toner and durability stability, desirable external additive agent are inorganic fine particles having a primary particle size of 50 to 1,000 nm, preferably 100 to 500 nm.

The toners, obtained as described above, can be used effectively in both of the mono-component developing system in which toner is electrically charged when passing through the contact section between the toner-regulating blade and the developing sleeve in the developing device, and the two-component developing system in which toner is electrically charged by friction with carrier. In general, the stress applied onto each toner particle is greater in the mono-component developing system than that in the two-component developing system. Therefore, toners used in the mono-component developing system require a higher stress-resistant properties than those used in the two-component developing system. With respect to the developing method, the toners are effectively applied to both of a contact developing method and a non-contact developing method.

Even when applied to a small-particle-size toner which contains as its main component a low-softening-point binder resin that is suitable for a high-image quality, low consumption (highly-filled type of coloring material) and low-energy fixing system (these properties have been highly demanded in recent years) and which has coloring material highly-filled, the toner of the present invention exhibits an appropriate adhesive properties to the toner-supporting members (carrier, developer sleeves, developer rollers, etc.), photosensitive members and transferring members, and also has a superior moving properties. Thus, the toner of the present invention has a superior fluidity, improves the uniformity in electrical charge, and ensures a stable durability for a long time.

Production Example of Resin

Production examples of polyester resins A, B and C)

Into a four-knecked flask equipped with a thermometer, a stainless stirring stick, a dropping-type condenser and a nitrogen gas inlet pipe were put an alcohol component and an acid component together with a polymerization initiator (dibutyltinoxide) at a mole ratio shown in Table 1. This flask was placed on a mantle heater for heating to react while being stirred under a nitrogen gas flow. The progress of the reaction was followed by measuring its acid value. At the time of reaching a predetermined acid value, the reaction was completed, and cooled to room temperature. Thus, a polyester resin was obtained. The polyester resin was pulverized into not more than 1 mm, and was used for manufacturing toners which will be described later. The properties of the polyester resin thus obtained are shown in Table 1 as number-average molecular weight (Mn), weight-average molecular weight (Mw)/number-average molecular weight (Mn), glass transition point (Tg), softening point (Tm), acid value and hydroxide value.

In the Table, PO represents polyoxypropylene(2,2)-2,2-bis(4-hydroxyphenyl)propane, EO represents polyoxyethylene(2,0)-2,2-bis(4-hydroxyphenyl)propane, GL represents glycerin, TPA represents terephthalic acid, TMA represents trimellitic acid, and FA represents fumaric acid.

TABLE 1

| polyester | alcohol component | | | acid component | | | | | Tg | Tm | acid value | hydroxy value |
|---|---|---|---|---|---|---|---|---|---|---|---|---|
| resin | PO | EO | GL | FA | TPA | TMA | Mn | Mw/Mn | (° C.) | (° C.) | (KOHmg/g) | (KOHmg/g) |
| A | 4.0 | 6.0 | — | — | 9.0 | — | 3300 | 4.2 | 68.5 | 110.3 | 3.3 | 28.1 |
| B | 5.0 | 5.0 | — | 5.0 | 4.0 | — | 3800 | 3.0 | 68.3 | 102.8 | 3.8 | 28.7 |
| C | 3.0 | 7.0 | — | — | 7.0 | 2.0 | 2800 | 2.3 | 59.5 | 101.8 | 1.3 | 60.4 |

The various properties shown in Table 1 were measured as follows:

Measurements of the glass transition point Tg of resins

The glass transition point was measured by a differential scanning calorimeter (DSC-200: made by Seiko Denshi K.K.) in which: based upon alumina as the reference, 10 mg of a sample was measured under the conditions of a temperature-rise rate of 10° C./min and at temperatures ranging from 20 to 120° C. The shoulder value of the main endothermic peak was defined as the glass transition point.

Measurements of the softening point Tm of resins

The softening point was measured by a Flow Tester (CFT-500; made by Shimadzu Seisakusho K.K). A sample (1 $cm^3$) was fused and flowed under the following conditions; pore of die (diameter 1 mm, length 1 mm), a pressure of 20 $kg/cm^2$ and a temperature-rising rate of 6° C./min. Temperature corresponding to a ½ of the height from the flow-out start point to the flow-out completion point was taken as a softening point.

Measurements of the molecular weight

The molecular weight was measured by a gel permeation chromatography (807-IT Type: Nippon Bunko Kogyo K.K.) using tetrahydrofuran as a carrier solvent based upon polystyrene conversion.

Acid value

With respect to the acid value, 10 mg of a sample was dissolved in 50 ml of toluene, and this was titrated by a standardized solution of N/10 potassium hydroxide/alcohol in the presence of an indicator of 0.1% of bromo-thymol blue and phenol red. The acid value was calculated from the amount of consumption of the solution of N/10 potassium hydroxide/alcohol.

Hydroxide value

With respect to the hydroxide value, a weighed sample was treated by acetic anhydride, and an acetyl compound thus obtained was subjected to hydrolysis so that the number of mg of potassium hydroxide required for neutralizing isolated acetic acid was taken.

Production Example of Polyester Resin D (L-type)

Into a four-knecked glass flask equipped with a thermometer, a stirrer, a dropping-type condenser and a nitrogen gas inlet pipe were put polyoxypropylene(2,2)-2,2-bis(4-hydroxyphenyl)propane, polyoxyethylene(2,2)-2,2-bis (4-hydroxyphenyl)propane, isododecenyl succinic anhydride, terephthalic acid and fumaric acid so as to be adjusted at a weight ratio of 82:77:16:32:30, together with dibutyl tin oxide as a polymerization initiator. This flask was placed on a mantle heater for heating to react while being stirred at 220° C. under a nitrogen gas atmosphere. A polyester resin D (L-type) thus obtained had a softening point of 110° C., a glass transition point of 60° C. and an acid value of 17.5 KOH mg/g.

Production Example of Polyester Resin E (H-type)

Styrene and 2-ethylenehexyl acrylate were adjusted to a weight ratio of 17:3.2, and placed in a dropping funnel together with dicumylperoxide as a polymerization initiator. Into a four-kneck glass flask equipped with a thermometer, a stirrer, a dropping-type condenser and a nitrogen gas inlet pipe were put polyoxypropylene(2,2)-2,2-bis(4-hydroxyphenyl)propane, polyoxyethylene(2,2)-2,2-bis(4-hydroxyphenyl)propane, isododecenyl succinic anhydride, terephthalic acid, 1,2,4-benzenetricarboxylic acid anhydride and acrylic acid so as to be adjusted at a weight ratio of 42:11:11:11:8:1, together with dibutyl tin oxide as a polymerization initiator. This flask was placed on a mantle heater. The solution was stirred at 135° C. under a nitrogen gas atmosphere, with styrene, etc. being dropped therein from the dropping funnel, and then heated to 230° C. at which reaction was carried out. A polyester resin E (H-type) thus obtained had a softening point of 150° C., a glass transition point of 62° C. and an acid value of 24.5 KOH mg/g.

EXAMPLES

Preparation of Pigment Master Batch

With respect to pigments used in the preparation of the following full-color toners, each of thermoplastic resins used for Examples and C.I. Pigment Blue 15-3 were loaded into a pressure kneader at a weight ratio of 7:3, and kneaded at 120° C. for one hour. After cooled off, the kneaded material was coarsely pulverized by a hammer mill, to give a pigment master batch having a pigment content of 30 wt %.

Production Examples of Toner

Full-Color Toner

Production Example C-1

To 100 parts by weight of polyester resin A obtained in the production example of resin were added the master batch corresponding to a content of 4.0 parts by weight of C.I. Pigment Blue 15-3, 2.0 parts by weight of a zinc complex of salicylic acid (E-84; made by Orient Kagaku Kogyo K.K.) serving as a charge-control agent and 1 part by weight of oxidized-type low molecular weight polypropylene (100TS; made by Sanyo Kasei Kogyo K.K.: softening point 140° C., acid value 3.5). The mixture was sufficiently mixed in Henschel Mixer, and then fused and kneaded by a twin screw extruding kneader (PCM-30; made by Ikegai Tekkou K.K.) whose discharging section had been detached, and then cooled. The kneaded materials thus obtained was cooled off by a cooling belt, and then coarsely pulverized by a feather mill. Then, the coarsely pulverized material was pulverized by a mechanical pulverizer (KTM: made by Kawasaki Jyukogyo K.K.) to have an average particle size of 10 to 12 μm, and further pulverized and coarsely classified by a Jet mill (IDS: made by Nippon Pneumatic K.K.) to have an average particle size of 6.6 μm, and then finely classified by a rotor-type classifier (Teeplex classifier: 100 ATP; made by Hosokawa Micron K.K.). Thus, cyan toner particles (C-1) having a volume-average particle size of 7.1 μm was obtained.

Production Example C-2

Cyan toner particles (C-2) having an average particle size of 7.2 μm were obtained in a manner similar to C-1 except that polyester resin (in which resin B and resin C were blended at a ratio of 80:20) obtained in the production example of resin was used.

Production Example Bk-1

Polyester resin D (L-type) (40 parts by weight), 60 parts by weight of polyester resin E (H-type), 2 parts by weight of polyethylene wax (800P; made by Mitsui Sekiyu Kagaku K.K.; melt viscosity 5,400 cps at 160° C.; softening point 140° C. ), 2 parts by weight of polypropylene wax (TS-200; made by Sanyo Kasei Kogyo K.K.; melt viscosity 120 cps at 160° C.; softening point 145° C.; acid value 3.5 KOHmg/g), 8 parts by weight of acid carbon black (Mogul-L; made by Cabot K.K.; pH 2.5; average primary particle size 24 nm) and 2 parts by weight of a negative charge-control agent represented by the following formula were sufficiently mixed by Henschel Mixer, and melt and kneaded by a twin screw extruder kneader. The kneaded material was cooled off, coarsely pulverized by a hammer mill, and finely pulverized by a jet mill, and then classified. Thus, toner particles Bk-1 having a volume-average particle size of 7.2 m was obtained.

(A)

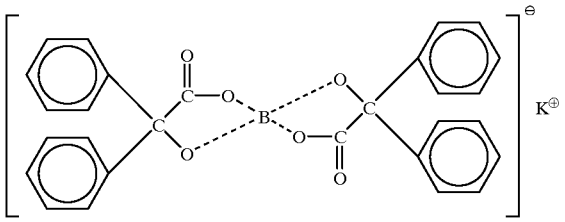

Magnetic Black Toner

Production Example Bk-2

Polyester resin D (L-type) (40 parts by weight), 60 parts by weight of polyester resin E (H-type), 2 parts by weight of polyethylene wax (800P; made by Mitsui Sekiyu Kagaku K.K.; melt viscosity 5,400 cps at 160 ° C.; softening point 140° C. ), 2 parts by weight of polypropylene wax (TS-200; made by Sanyo Kasei Kogyo K.K.; melt viscosity 120 cps; softening point 145° C.; acid value 3.5 KOHmg/g), 50 parts by weight of magnetic particles (Magnetite; EPT-1,000: made by Toda Kogyo K.K.) and 2 parts by weight of chrome complex serving as a negative charge-control agent (Aizen Spilon black TRH; made by Hodogaya Kagaku K.K.) were sufficiently mixed by Henschel Mixer, and melt and kneaded by a twin screw extruding kneader. Then, the kneaded material was cooled off, coarsely pulverized by a hammer mill, and finely pulverized by a jet mill, and then classified. Thus, toner particles Bk-2 having a volume-average particle size of 7.1 μm was obtained.

Binder-type carrier

Carrier-1

Polyester resin (100 parts by weight) (made by Kao K.K.: NE-1110), 700 parts by weight of magnetic particles (Magnetite: EPT-1,000; made by Toda Kogyo K.K.) and 2 parts by weight of carbon black (Mogul-L; made by Cabot K.K.) were sufficiently mixed by Henschel Mixer, and melt and kneaded by a twin screw extruding kneader which was set at 180° C. in the cylinder section and at 170° C. in the cylinder head section. Then, the kneaded material was cooled off, coarsely pulverized by a hammer mill, and finely pulverized by a jet mill, and then classified. By adjusting the finely pulverizing and classifying conditions, carrier particles, called as carrier-1, having a volume-average particle size of 45 μm were obtained.

Coat carrier

Carrier-2

Into a 500 ml flask equipped with a stirrer, a condenser, a thermometer, a nitrogen inlet pipe and a dropping device was put 100 parts by weight of methylethylketone. To 100 parts by weight of methylethylketone were dissolved 36.7 parts by weight of methylmethacrylate, 5.1 parts by weight of 2-hydroxyethyl methacrylate, 58.2 parts by weight of 3-methacryloxypropyltris(trimethylsiloxy)silane and 1 part by weight of 1,1'-azobis(cyclohexane-1-carbonitrile) at 80° C. under a nitrogen atmosphere. The resultant solution was dropped into the reactor vessel in two hours, and matured for 5 hours.

To a resin thus obtained was added as a cross-linking agent an isophoronediisocyanate/trimethylolpropane adduct (IPDI/TMP series: NCO %=6.1%) so as to adjust the OH/NCO mole ratio to 1/1. The obtained resin solution was diluted by methylethylketone so as to have a solid content of 3% by.

By using calcined ferrite particles F-300 (volume-average particle size:50 μm, made by Powdertech K.K.) as a core material, the coat resin solution was applied thereto and dried by SPIRA COTA (made by Okada Seiko K.K.) so that an amount of coated resin to the core material was set at 1.5% by weight.

The resultant carrier was left in a hot-air circulating oven for one hour at 160° C. for curing. After cooled, the ferrite particle bulk was pulverized by a sieve shaker having screen meshes of 106 μm and 75 μm to give carrier 2 having an volume-average particle size of 47 μm.

The average particle size and its distribution were made by Coulter Multisizer II (made by Coulter Counter K.K.) with an aperture tube diameter of 50 μm. The particle size of the carrier was measured by Coulter Multisizer II (made by Coulter Counter K.K.) with an aperture tube diameter of 150 μm.

The obtained toners C-1 and C-2, and toners Bk-1 and Bk-2 were subjected to pre-treatment in combination with inorganic fine particles as shown in Table 2, and were then subjected to a heating treatment by an instantaneous heating device having a construction as shown in FIG. 1. Finally, these toners were subjected to post-treatment in combination with inorganic fine particles as shown in Table 2. Thus toners A through P were obtained. The pre-treatment conditions, heating treatment conditions and post-treatment conditions are shown below:

TABLE 2

| | Toner | | Pre-treating agent | | | | Temperature | Post-treating material | | | |
|---|---|---|---|---|---|---|---|---|---|---|---|
| | Toner | base particle | Material | Amount of addition | Material | Amount of addition | for heating treatment | Material | Amount of addition | Material | Amount of addition |
| Example 1 | A | C-2 | 4 | 1.0 | 1 | 0.3 | 200° C. | 2 | 0.5 | b | 0.5 |
| Example 2 | B | C-2 | 4 | 1.0 | 1 | 0.3 | 250° C. | 2 | 0.5 | b | 0.5 |
| Example 3 | C | C-2 | 4 | 1.0 | 1 | 0.3 | 300° C. | 2 | 0.5 | b | 0.5 |
| Example 4 | D | C-1 | 4 | 1.0 | 1 | 0.3 | 250° C. | 2 | 0.5 | b | 0.5 |
| Example 5 | E | C-2 | 4 | 1.0 | 1 | 0.3 | 250° C. | 4 | 0.5 | — | — |
| Example 6 | F | C-2 | 4 | 1.0 | 1 | 0.3 | 250° C. | 2 | 0.5 | 4 | 0.5 |
| Example 7 | G | C-2 | 4 | 1.0 | 5 | 0.5 | 250° C. | 2 | 0.5 | b | 0.5 |
| Example 8 | H | C-2 | 4 | 1.0 | — | — | 250° C. | 4 | 0.8 | 5 | 0.4 |
| Example 9 | I | B k-1 | 4 | 2.0 | — | — | 270° C. | 2 | 0.5 | a | 0.5 |
| Example 10 | J | C-2 | 4 | 1.0 | 1 | 0.3 | 250° C. | 2 | 0.5 | b | 0.5 |
| Example 11 | L | B k-1 | 4 | 1.0 | 1 | 0.3 | 270° C. | 2 | 0.5 | b | 0.5 |
| Example 12 | M | B k-2 | 4 | 1.0 | 1 | 0.3 | 300° C. | 2 | 0.5 | b | 0.5 |
| Comparative Example 1 | N | C-2 | 1 | 1.0 | — | — | 250° C. | 1 | 0.5 | — | — |
| Comparative Example 2 | O | C-2 | 3 | 1.0 | — | — | 250° C. | 3 | 0.8 | 5 | 0.4 |
| Comparative Example 3 | P | C-2 | 6 | 1.0 | 1 | 0.3 | 250° C. | 2 | 0.5 | b | 0.5 |

| | | Toner particle size | | | Average degree of roundness | |
|---|---|---|---|---|---|---|
| | | Particle | Coarse particle size | Fine particle size | | |
| | Carrier | size D50 μm | not less than 2 D Weight % | not more than 1/3 D Number % | Degree of roundness | Standard deviation SD % |
| Example 1 | — | 7.1 | 0.1 | 2.9 | 0.962 | 0.034 |
| Example 2 | — | 7.1 | 0.1 | 2.8 | 0.981 | 0.026 |
| Example 3 | — | 7.3 | 0.1 | 2.5 | 0.991 | 0.018 |
| Example 4 | — | 7.1 | 0.1 | 2.8 | 0.981 | 0.026 |

TABLE 2-continued

| | | | | | | |
|---|---|---|---|---|---|---|
| Example 5 | — | 7.1 | 0.1 | 2.8 | 0.981 | 0.026 |
| Example 6 | — | 7.1 | 0.1 | 2.8 | 0.981 | 0.026 |
| Example 7 | — | 7.1 | 0.1 | 2.8 | 0.981 | 0.026 |
| Example 8 | — | 7.1 | 0.1 | 2.8 | 0.981 | 0.026 |
| Example 9 | — | 7.2 | 0.1 | 4.1 | 0.980 | 0.030 |
| Example 10 | 2 | 7.1 | 0.1 | 2.8 | 0.981 | 0.026 |
| Example 11 | 1 | 7.2 | 0.1 | 4.1 | 0.980 | 0.030 |
| Example 12 | — | 7.1 | 0.1 | 3.8 | 0.976 | 0.035 |
| Comparative Example 1 | — | 7.1 | 0.1 | 2.8 | 0.981 | 0.026 |
| Comparative Example 2 | — | 7.4 | 0.1 | 2.5 | 0.983 | 0.027 |
| Comparative Example 3 | — | 7.1 | 0.1 | 2.8 | 0.981 | 0.026 |

The reference numbers of inorganic fine particles shown in Table 2 indicates the following inorganic fine particle numbers.

Inorganic fine particle 1 (hydrophobic silica: degree of hydrophobicity 55%, average primary particle size 7 nm; TS 500; made by, Cabozyl K.K.). The ratio of the number of particles of less than 15 nm (A), that in the range of 15 to 30 nm (B) and that not less than 30 nm (C) was B/A=0.1, B/C=0.

Inorganic fine particle 2 (hydrophobic silica: degree of hydrophobicity 48%, average primary particle size 12 nm, R974; made by Nippon Aerosil K.K.). The ratio of the number of particles of less than 15 nm (A), that in the range of 15 to 30 nm (B) and that not less than 30 nm (C) was B/A=0.3, and B/C=0.

Inorganic fine particle 3 (hydrophobic silica: degree of hydrophobicity 65%, average primary particle size 35 nm, NAX 50; made by Nippon Aerosil K.K.). The ratio of the number of particles of less than 15 nm (A), that in the range of 15 to 30 nm (B) and that not less than 30 nm (C) was B/A=15, and B/C=0.5.

Inorganic fine particle 4: AEROSIL 90G(made by Nippon Aerosil K.K.)(silica fine particle) subjected to a surface-modifying treatment by hexamethylenedisilazane (degree of hydrophobicity 67%, average primary particle size 22 nm). The ratio of the number of particles of less than 15 n=(A), that in the range of 15 to 30 nm (B) and that not less than 30 nm (C) was B/A=8 and B/C=13.

(Production Example of Hydrophobic Titanium Oxide)-Inorganic Fine Particle 5

Hydrate titanium oxide was obtained by the sulfuric acid method, washed, and then calcined at 300° C. to give titanium oxide having an average primary particle size of 15 nm. To an aqueous system containing this titanium oxide at a ratio of 2% by weight was added n-butyltrimethoxysilane serving as a hydrophobic agent at a ratio of 10% by weight relative to the titanium oxide particles, while being mixed and stirred. This mixture was dried and pulverized to give inorganic fine particle 5, that is, hydrophobic titanium oxide fine particles having a BET specific surface area of 112 $m^2/g$ and a degree of hydrophobicity of 55%.

(Production Example of Hydrophobic Titanium Oxide)-Inorganic Fine Particle 6

Hydrate titanium oxide was obtained by the sulfuric acid method, washed, and then calcined at 300° C. to give titaniumoxide having an average primary particle size of 21 nm. To an aqueous system containing this titanium oxide at a ratio of 2% by weight was added n-butyltrimethoxysilane serving as a hydrophobic agent at a ratio of 10% by weight relative to the titanium oxide particles, while being mixed and stirred. This mixture was dried and pulverized to give inorganic fine particle 6, that is, hydrophobic titanium oxide fine particles having a degree of hydrophobicity of 55%.

The inorganic fine particle 6 had an average primary particle size of 21 nm, and a ratio of the number of particles less than 15 nm (A), that in the range of 15 to 30 nm (B) and that not less than 30 nm (C) was B/A=9 and B/C=8.

Inorganic fine particle a:

Rutile-type titanium dioxide (KR-380; made by Titan Kogyo K.K.) having an average primary particle size of 250 nm, which was subjected to a surface-modifying treatment with n-butyltrimethoxysilane in an aqueous system (degree of hydrophobicity 50%).

Inorganic fine particle b

Preparation of Hydrophobic Strontium Titanate Particles (Strontium titanate particle A)

Titanium oxide and strontium carbonate were calcined to give strontium titanate particle A having a number-average particle size 250 nm.

Particle A was subjected to an elution treatment of strontium carbonate in a solution of hydrochloric acid, washed and dried to give strontium titanate particle A0.

The resultant A0 was subjected to a qualitative analysis by means of X-ray diffraction, with the result that no peak of strontium carbonate was detected.

Particle A0 was subjected to a surface-modifying treatment with n-butyltrimethoxysilane at an amount of 0.5 wt % by a dry method, to give hydrophobic strontium titanate particle A1 (inorganic fine particle b).

Conditions of pre-treatment

Mixing process was carried out by Henschel Mixer (peripheral speed 40 m/sec, for 60 seconds).

Conditions of heating treatment

Developer-supplying section; Table feeder+vibration feeder

Dispersing nozzle; Four (Symmetric layout with 90 degrees respectively to all circumference)

Ejecting angle; 30 degrees

Amount of hot air; 800 L/min

Amount of dispersing air; 55 L/min

Amount of suction air; −1200 L/min

Dispersion density; 100 $g/m^3$

Residence time; 0.5 second

Temperature of cooling air; 15° C.

Temperature of cooling water; 10° C.

Processing temperature; shown in Table 2

Conditions of post-treatment

A mixing process was carried out by Henschel Mixer (peripheral speed 40m/sec. for 150 seconds).

With respect to toners obtained in Examples 1 through 12 and Comparative Examples 1 through 3, evaluation was made on cleaning properties, scattering and heat resistance and observation on sleeve. Results thereof are shown in Table 3.

(Cleaning properties 1)

In the Case of Mono-Component System

Examples 1 through 9, Comparative Examples 1 through 3

After 50 copies was made by a full-color printer "Color PageProTM PS" (made by Minolta K.K.) under L/L environment (low-temperature, low-moisture environment), evaluation was made (referred to "initial" in Table). Under N/N environment, after 50 copies was made, evaluation was made (referred to "initial" in Table) and after 2,000 copies was made, evaluation was also made (referred to "after endurance copy" in Table) The evaluation was carried out by visually observing the surfaces of the photosensitive member and the intermediate transfer member.

The copying was carried out using a predetermined print pattern having a ratio of B/W of 6%.

(Criterion of Evaluation)

○: Neither filming nor BS were observed; no problem arose.

Δ: Filming and BS were observed on either of the devices; however, no adverse effect was observed on copied images.

X: Filming and BS were observed and their adverse effects were observed on copied images.

(Cleaning properties 2)

In the Cases of Two-Component System (Examples 10 and 11)

A starter was installed in a full-color copying machine (CF900: made by Minolta K.K.). After 100 copies was made under L/L environment (low-temperature, low-moisture environment) by using a document having an image portion 15%, evaluation was made (referred to "initial" in Table) Under N/N environment, after 100 copies (referred to "initial" in Table) and after 50,000 copiey (referred to "after endurance copy" in Table), evaluation was made. The evaluation was respectively made by observing filming and BS on the photosensitive member.

(Criterion of evaluation)

○: Neither filming nor BS were observed.

Δ: Filming and BS were observed; however, no adverse effect was observed on copied images.

X: Filming and BS were observed and their adverse effects were observed on copied images.

(Scattering)

In the Case of Mono-Component System (Examples 1 through 9 and Comparative Examples 1 through 3)

With respect to quality evaluation, copied images at the initial stage and after endurance copy in N/N environment were evaluated.

A full-color printer "Color PageProTM PS" (made by Minolta K.K.) was used.

(Criterion of evaluation)

○: Almost no scattering was virtually observed on the copied images.

Δ: Scattering was slightly observed on the copied image; however, no problem arose in practical use.

X: Scattering was observed in many portions on the copied image, raising problems in practical use such as fog, etc. on the copied images.

(Scattering)

In the Case of Two-Component System (Examples 10 and 11)

With respect to quality evaluation, copied images at the initial stage and after endurance copy in N/N environment were evaluated.

A full-color copying machine (CF900:made by Minolta K.K.) was used.

(Criterion of evaluation)

○: Almost no scattering was virtually observed on the copied images.

Δ: Scattering was slightly observed occurred on the copied image; however, no problem arose in practical use.

X: Scattering was observed in many portions on the copied image, raising problems in practical use such as fog, etc. on the copied images.

(Observation on SL)

In the Case of Mono-Component System (Examples 1 through 9, Comparative Examples 1 through 3)

By using a full-color printer "Color PageProTM PS" (made by Minolta K.K.), solid images were printed at the initial stage and after 2,000 continuous copy in N/N environment. The surface of the sleeve and the copied images were observed.

(Criterion of evaluation)

○: Neither lines nor irregularity was observed on the sleeve.

Δ: Lines or irregularity was observed on the sleeve; however, no longitudinal lines appeared on the copied images, causing no problem in practical use.

X: Lines or irregularity was observed on the sleeve, raising problems in practical use such as longitudinal lines on the copied images and toner-dropping.

(Heat resistance)

Toner (10 g) was put into a 50 cc glass bottle, plugged, and kept in a constant temperature bath at 55° C. for 24 hours. After taken out, the bottle was slightly shaken and toner was spread on A-4 paper for observation.

○: Easily crumbled; no aggregated particles were observed.

Δ: Soft aggregation was partially observed, but easily crumbled.

X: There were aggregation of solidified particles and clumps that were hardly crumbled.

TABLE 3

| | Cleaning properties BS, filming | | | Scattering | | Heat resistance | Observation on SL | |
|---|---|---|---|---|---|---|---|---|
| | N/N | | | N/N | | | N/N | |
| | Initial | After endurance copying | L/L Initial | Initial | After endurance copying | Strage properties | Initial | After endurance copying |
| Example 1 | ○ | ○ | ○ | ○ | ○ | ○ | ○ | ○ |
| Example 2 | ○ | ○ | ○ | ○ | ○ | ○ | ○ | ○ |
| Example 3 | ○ | ○ | ○ | ○ | ○ | ○ | ○ | ○ |

TABLE 3-continued

| | Cleaning properties BS, filming | | | Scattering | | | Observation on SL | |
|---|---|---|---|---|---|---|---|---|
| | N/N | | | N/N | | Heat resistance | N/N | |
| | Initial | After endurance copying | L/L Initial | Initial | After endurance copying | Strage properties | Initial | After endurance copying |
| Example 4 | ○ | ○ | ○ | ○ | ○ | ○ | ○ | ○ |
| Example 5 | ○ | ○ | ○ | ○ | ○ | ○ | ○ | ○ |
| Example 6 | ○ | ○ | ○ | ○ | ○ | ○ | ○ | ○ |
| Example 7 | ○ | ○ | ○ | ○ | ○ | ○ | ○ | ○ |
| Example 8 | ○ | ○ | ○ | ○ | ○ | ○ | ○ | ○ |
| Example 9 | ○ | ○ | ○ | ○ | ○ | ○ | ○ | ○ |
| Example 10 | ○ | ○ | ○ | ○ | ○ | ○ | — | — |
| Example 11 | ○ | ○ | ○ | ○ | ○ | ○ | — | — |
| Example 12 | ○ | ○ | ○ | ○ | ○ | ○ | ○ | ○ |
| Comparative Example 1 | X | — | X | X | — | X | Δ | — |
| Comparative Example 2 | ○ | X | Δ | ○ | ○ | Δ | X | X |
| Comparative Example 3 | Δ | — | X | X | — | Δ | Δ | — |

Comparative Example 1: The fluidity was too high.

Comparative Example 2: Isolated silica particles gave adverse effects. Little coating properties.

Comparative Example 3: Slight lines appeared from the initial stage. Evaluation was made only at the initial stage due to adherence.

The toner of the present invention can perform excellent heat resistance and cleaning properties while utilizing the characteristics of toner having a spherical or near spherical uniform shape, Excellent images can be formed without scattering and lines on the copied images.

What is claimed is:

1. A production method of toner particles, comprising the steps of:

mixing a binder resin and a colorant;

melting and kneading the mixture;

pulverizing the kneaded material;

classifying the pulverized materials to give a colored resin particles;

mixing the colored resin particles with a plurality of silica particles, the plurality of silica particles mixed with the colored resin having an average primary particle size of 16 to 28 nm and satisfying the relation (B)/(A)>4 and (B)/(C)>4, where (a) is the number of particles that are less than 15 mn in particle size, (B) is the number of particles that are between 15 and 30 nm in particle size and (C) is the number of particles that are larger than 30 nm in particle size; and heat-treating the resultant mixture to make the colored resin particles spherical and to make the silica particles fixed on the surface of the colored resin particles, to obtain toner particles.

2. The production method of claim 1, in which the toner particles have an average degree of roundness from 0.960 to 1.0 and a standard deviation of degree of roundness of not more than 0.040.

3. The production method of claim 2, in which the average degree of roundness is 0.960 to 0.955 and the standard deviation of degree of roundness is not more than 0.035.

4. The production method of claim 1, in which the silica particles have the average primary particle size of 18 to 25 nm.

5. The production method of claim 1, in which (B)/(A)>5 and (B)/(C)>5.

6. The production method of claim 1, in which the binder resin has a glass transition point of 50 to 75° C., a softening point of 80 to 120° C., a number-average molecular weight of 2,500 to 30,000 and a ratio of weight-average molecular weight/number-average molecular weight in the range of 2 to 20.

7. The production method of claim 1, in which the binder resin is a polyester resin having an acid value of 2 to 50 KOHmg/g.

8. The production method of claim 1, in which the binder resin comprises a first resin having a glass transition point of 50 to 75° C. and a softening point of 80 to 125° C. and a second resin having a glass transition point of 50 to 75° C. and a softening point of 125 to 160° C., the softening point of the second resin being 10° C. or more higher than that of the first resin.

9. A production method of toner, comprising the steps of:

mixing a binder resin and a colorant;

melting and kneading the mixture;

pulverizing the kneaded material;

classifying the pulverized materials to give a colored resin particles;

mixing the colored resin particles with a plurality of silica particles surface-treated with a hydrophobic agent, the plurality of silica particles mixed with the colored resin particles having an average primary particle size of 16 to 28 nm and satisfying the relation (B)/(A)>4 and (B)/(C)>4, where A is the number of particles that are less than 15 nm in particle size, B is the number of particles that are between 15 and 30 nm in particle size and C is the number of particles that are larger than 30 nm in particle size;

heat treating the resultant mixture to make the colored resin particles spherical and to make the silica particles fixed on the surface of the colored resin particles, to obtain toner particles; and adding inorganic fine particles surface-treated with a hydrophobic agent and having an average primary particle size of 5 to 30 nm to the toner particles, to obtain toner.

10. The production method of claim 9, in which the toner particles have an average degree of roundness from 0.960 to 1.0 and a standard deviation of degree of roundness of not more than 0.040.

11. The production method of claim 10, in which the average degree of roundness is 0.960 to 0.955 and the standard deviation of degree of roundness is not more than 0.035.

12. The production method of claim 9, in which the silica particles have the average primary particle size of 18 to 25 nm.

13. The production method of claim 9, in which (B)/(A)>5 and (B)/(C)>5.

14. The production method of claim 9, in which the binder resin has a glass transition point of 50 to 75° C., a softening point of 80 to 120° C., a number-average molecular weight of 2,500 to 30,000 and a ratio of weight-average molecular weight/number-average molecular weight in the range of 2 to 20.

15. The production method of claim 9, in which the binder resin is a polyester resin having an acid value of 2 to 50 KOHmg/g.

16. The production method of claim 9, in which the binder resin comprises a first resin having a glass transition point of 50 to 75° C. and a softening point of 80 to 125° C. and a second resin having a glass transition point of 50 to 75° C. and a softening point of 125 to 160° C., the softening point of the second resin being 10° C. or more higher than that of the first resin.

* * * * *